US005402940A

United States Patent [19]

Haller et al.

[11] Patent Number: 5,402,940

[45] Date of Patent: * Apr. 4, 1995

[54] TRIBO-ELECTRIC POWDER SPRAY GUN

[75] Inventors: Curtis B. Haller, Lorain; Alan J. Knobbe, Amherst; Gerald W. Crum, Elyria, all of Ohio

[73] Assignee: Nordson Corporation, Westlake, Ohio

[ * ] Notice: The portion of the term of this patent subsequent to Sep. 6, 2011 has been disclaimed.

[21] Appl. No.: 262,970

[22] Filed: Jun. 21, 1994

Related U.S. Application Data

[63] Continuation of Ser. No. 956,615, Oct. 5, 1992, Pat. No. 5,344,082.

[51] Int. Cl.[6] ..... B05B 5/047

[52] U.S. Cl. ..... 239/697; 239/690; 239/706; 239/600

[58] Field of Search ..... 239/690, 697, 698, 704, 239/706, 708, 600; 118/620, 621, 629

[56] References Cited

U.S. PATENT DOCUMENTS

| | | | |
|---|---|---|---|
| 3,903,321 | 9/1975 | Schaad | 239/602 X |
| 4,135,667 | 1/1979 | Benedek et al. | 239/697 |
| 4,214,709 | 7/1980 | Scull et al. | 239/707 |
| 4,225,090 | 9/1980 | Kako et al. | 239/692 |
| 4,228,961 | 10/1980 | Itoh | 239/707 X |
| 4,289,278 | 9/1981 | Itoh | 239/706 |
| 4,316,582 | 2/1982 | Kobayashi et al. | 239/692 |
| 4,359,192 | 11/1982 | Takahaski et al. | 239/692 |
| 4,399,945 | 8/1983 | Ruud | 239/697 |
| 4,401,275 | 8/1983 | Ruud . | |
| 4,417,696 | 11/1983 | Kako et al. | 239/690 |
| 4,615,649 | 10/1986 | Sharpless . | |
| 4,659,019 | 4/1987 | Talacko | 239/692 |
| 4,706,890 | 11/1987 | Talacko | 239/692 |
| 4,747,546 | 5/1988 | Talacko | 239/707 |
| 4,788,933 | 1/1989 | Buschor | 239/692 X |
| 4,798,338 | 1/1989 | Bauch et al. | 239/692 |
| 4,798,340 | 1/1989 | Vöhringer et al. | 239/692 |
| 4,815,666 | 3/1989 | Gacka et al. | 239/706 X |
| 4,886,215 | 12/1989 | Ruud | 239/692 X |
| 4,921,172 | 5/1990 | Belmain et al. | 239/698 |
| 4,966,330 | 10/1990 | Loof | 239/690 |
| 4,979,680 | 12/1990 | Bauch et al. | 239/692 |
| 5,002,229 | 3/1991 | Schneider et al. | 239/600 X |
| 5,011,085 | 4/1991 | Lööf | 239/690 |

FOREIGN PATENT DOCUMENTS

| | | | |
|---|---|---|---|
| 0252954 | 7/1987 | European Pat. Off. . | |
| 1487141 | 6/1967 | France | 239/600 |
| 3013891 | 7/1982 | Germany . | |
| 258188 | 7/1988 | Germany | 239/690 |
| 3924425 | 12/1990 | Germany . | |
| 371967 | 12/1974 | Sweden . | |
| 1210900 | 2/1986 | U.S.S.R. | 239/690 |
| 1246464 | 3/1987 | U.S.S.R. | 239/690 |
| 8808332 | 11/1988 | WIPO . | |
| 9211949 | 7/1992 | WIPO . | |
| 9211950 | 7/1992 | WIPO . | |

OTHER PUBLICATIONS

Tribomatic® Automatic Powder Spray Gun, Manual No. 37-1, copyright 1990, pp. 3 and 12.

Tribomatic® Generation 3 Automatic Gun Diffuser, Manual No. 37-17, copyright 1991, p. 1.

*Primary Examiner*—William Grant

*Attorney, Agent, or Firm*—Rankin, Hill, Lewis & Clark

[57] ABSTRACT

A tribo-electric powder spray gun includes a diffuser for mixing powder with a conveying gas, a charging portion downstream of the diffuser, and a sprayhead at the outlet of the charging portion for dispensing the charged powder. The charging portion has an inner core removably positioned within a hollow outer cylinder with an annular gap formed between the outer cylinder and inner core providing a charging flowpath for the powder. The inner core and the outer cylinder have undulating or wavy charging surfaces made of an electrically insulating material, so that the annular gap provides a tortuous path for the powder, enhancing powder contact and the charge imparted to the powder. Grounding is provided by surface conduction of the electrically insulating contact material through a ground ring located outside the powder path at the inlet to the charging portion of gun where the greatest amount of charging occurs. By locating the ground ring outside the powder path, the ground ring is kept clean and the amount of charging surface is maximized. The inner core and the outer cylinder are longitudinally symmetrical to facilitate re-assembly.

28 Claims, 7 Drawing Sheets

TRIBO-ELECTRIC POWDER SPRAY GUN

This is a continuation of application Ser. No. 956,615, filed Oct. 5, 1992, now U.S. Pat. No. 5,344,082.

BACKGROUND OF THE INVENTION

1. Field of the Invention

This invention relates to electrostatic powder painting, and more particularly to improved tribo-electric powder spray guns.

2. Description of the Prior Art

In electrostatic powder painting, dry paint particles are fluidized in a powder hopper and pumped through a hose to a spray gun which sprays the powder onto a product to be coated. The spray gun typically charges the powder in one of two ways—either the gun has a high voltage charging electrode, or the gun has means to charge the powder by friction, i.e., tribo-electrically. This invention relates to tribo-electric powder spray guns.

Generally, in tribo-electric powder guns, the powder is epoxy based, and surfaces are provided within the gun, typically constructed from polytetrafluoroethylene (PTFE), which the powder particles impact numerous times to frictionally charge the particles. When the powder particles are sprayed from the front of the gun, they are electrostatically attracted to the product to be painted which is generally electrically grounded and suspended from an overhead conveyer. Once these electrostatically charged powder particles are deposited onto the product, they adhere there by electrostatic attraction until they are conveyed into an oven where they are melted to flow together to form a continuous coating on the product. Powder coating generally provides a tough and durable finish such as would be found on many appliances, garden furniture, lawn mowers, and other products.

One commercially available tribo-electric powder spray gun is shown in U.S. Pat. No. 4,399,945. This gun is available as a Tribomatic ® gun from Nordson Corporation, Amherst, Ohio. In this gun, the powder is charged in a bundle of curved PTFE tubes which are wrapped around a core. As the powder passes through the tubes, it impacts the interior walls of the tubes several times and picks up charge upon each contact. The outer layer of the tube bundle is covered by a conductive material to bleed the charge to ground during operation of the gun. The grounding of the charge tubes enhances the charging of the powder and promotes safety by preventing the gun from storing a capacitive charge which could shock an operator or produce a spark, causing a fire or explosion.

One of the important factors in the magnitude of the charge imparted to the powder is the velocity of the powder through the gun; the higher the velocity of the powder, the higher the charge on the powder. Therefore, the powder is caused to flow through the gun at a high velocity in order to increase the charge on the powder. However, the velocity of the powder also has a detrimental effect on the wear life of the powder gun parts. Wear of the parts is also a function of velocity; the higher the velocity, the higher the wear. The powder abrades through the walls of the charge tubes in the charging portion of the gun with the result that the entire gun must be periodically returned to the manufacturer for rebuilding, at which time it is replaced by an entirely new or rebuilt gun.

Another important element in the performance of tribo-electric powder spray guns is the electrostatic grounding of the gun. Grounding of the prior art gun shown in U.S. Pat. No. 4,399,945 involves a very time-consuming and complicated manufacturing process. The charging tubes are preformed into convoluted shapes by heating them in special molds. The tubes were then arranged around an aluminum core and sprayed with a black graphite type conductive coating. A conductive wrapping is then applied around the entire tube bundle. A ground wire is extended from the core to the control panel for the unit.

SUMMARY OF THE INVENTION

The present invention provides a tribo-electric powder spray gun having an improved powder flowpath using the arrangement of a core within a sleeve or cylinder, wherein the powder flowpath is provided between the exterior of the core and the interior of the cylinder. More specifically, the interior of the cylinder and the exterior of the core are provided with undulating or wavy surfaces, so that an annular wavy flowpath for the powder is provided within the gun. Both the exterior of the core and the interior of the cylinder are provided with surfaces of PTFE. The wavy surfaces of the core and the cylinder cause the powder to change direction and contact the PTFE charging surfaces numerous times while passing through the charging portion of the gun, with the powder particles picking up charge on each contact. The exterior of the core and interior of the cylinder are held to a close tolerance so that the powder flowpath is very narrow, further increasing the number of times each powder particle hits a charging surface.

The present invention also provides improved electrostatic grounding of the gun. The present invention provides an improved and simplified grounding path that avoids the time consuming and complicated manufacturing process previously required for prior art guns, such as that described in U.S. Pat. No. 4,399,945. The present invention improves on the prior art design by incorporating a ground ring at the beginning of, but outside of, the powder flowpath.

The present invention uses the unique "wavy" core and cylinder charging design in combination with an external ground ring. By placing the ground ring outside of the flowpath, the ground ring is kept clean. In addition, by placing the ground ring at the inlet to the charging portion of gun, the ground ring is located where the greatest amount of charging occurs, and this location is the ideal place to bleed off charge.

The contact surfaces in the charging portion of the gun of the present invention are made from an electrically insulating material, such as PTFE, that provides good tribo-electric charging properties. While this material is electrically insulating, grounding is accomplished using surface discharge or surface conduction from the contact surfaces to the ground ring. Since the charging portion comprises separate elements, a gap is formed between these elements. In accordance with the present invention, the surfaces of this gap are used as part of the surface conduction path, and the gap is located adjacent to the position of the ground ring.

The present invention also provides an improved core and cylinder design in which the core with a wavy exterior surface can be inserted into and removed from the cylinder with a wavy interior surface. This removability is accomplished by dimensioning the diameter of the peaks or ridges of the inner core to be less than or at most equal to the diameter of the peaks or ridges of the outer cylinder. This design provides an important advantage over the prior art designs, because, when either of the charging surfaces becomes worn out, a new core and/or cylinder can easily be substituted in the field without the necessity of sending the entire gun back to the manufacturer to be rebuilt. This produces savings in time and expense.

The inner core and the outer cylinder each include a wear sleeve that is designed for easy removability and replacement. Each of the wear sleeves is formed of a stiffening element of an electrically insulating, dimensionally stable material, such as NEMA Grade G-10 material, and has a contact layer of an electrically insulating contact material, such as PTFE.

Furthermore, wear sleeves on both the inner core and the outer cylinder are longitudinally symmetrical, so that the gun can be re-assembled with either end of the wear sleeves inserted first. This simplifies assembly of the gun and prevents improper assembly through inadvertently mounting one of the wear sleeves backwards.

The present invention also provides a diffuser in the back of the gun to control the charge on the powder by driving the powder through the charging portion at the desired velocity. Prior art guns providing an annular gap for the charging of powder used an air nozzle at the rear of the charging portion which was provided only for the purpose of keeping the electrode clean.

These and other advantages are provided by the present invention of a powder spray gun which comprises a diffuser for mixing powder with a conveying gas, a charging portion downstream of the diffuser, and a sprayhead at the outlet of the charging portion for dispensing the charged powder. The charging portion includes means for electrically charging the powder as it flows therethrough. The charging means comprises an inner core removably positioned within a hollow outer cylinder. The outer cylinder has an inner dimension, and the inner core has an outer dimension. An annular gap is formed between the outer cylinder and inner core providing a charging flowpath for the powder. The outer dimension of the inner core increases at generally the same longitudinal position that the inner dimension of the outer cylinder increases. The outer dimension of the inner core decreases at generally the same longitudinal position that the inner dimension of the outer cylinder decreases. The width of the annular gap remains generally constant along the length of the outer cylinder and the inner core. The frictional charge which builds up on the inner core and outer cylinder surfaces flows along those surfaces to a ground ring located externally to the flowpath of the powder. The powder is charged by repeated contact with the surfaces during flow through the channel.

DETAILED DESCRIPTION OF THE PREFERRED EMBODIMENTS

Figure 1:
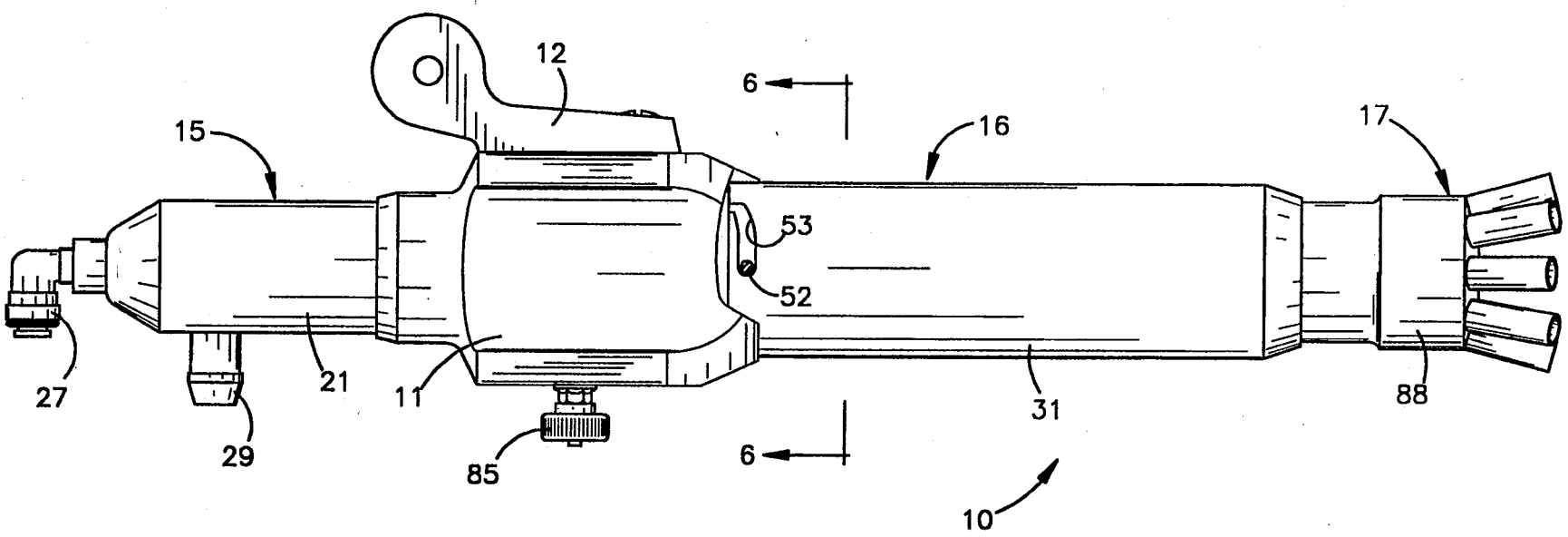
FIG. 1 is a side elevational view of the gun of the present invention with a portion of the gun body removed to show the pin from the gun body in cross section extending into the slot on the tube extension, forming the bayonet-type latching mechanism.
Figure 2:
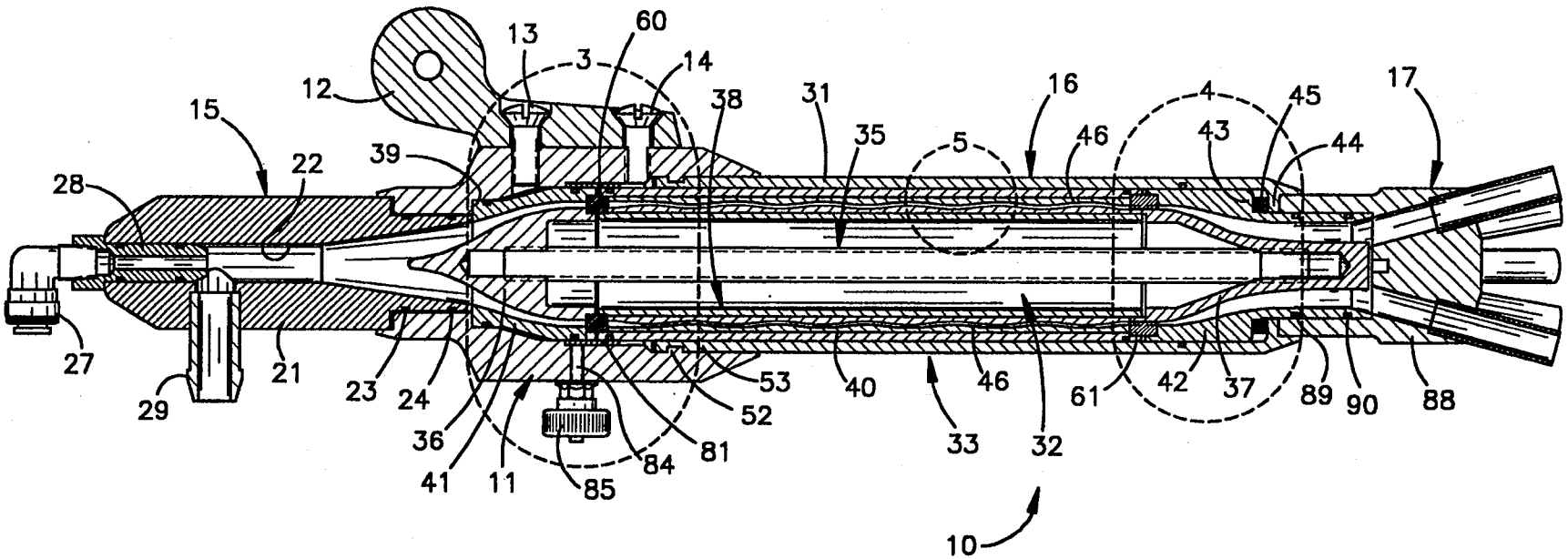
FIG. 2 is a cross-sectional side view of the gun of FIG. 1 taken along line 2—2 of FIG. 6.

Referring more particularly to the drawings and initially to FIGS. 1 and 2, there is shown the tribo-electric powder spray gun 10 of the present invention. The gun 10 includes a gun body 11 having a central opening extending therethrough. A gun mount assembly 12 is attached to the gun body 11 by means of fasteners 13 and 14. The gun 10 comprises a diffuser portion 15 at the inlet, a charging portion 16 in the middle, and the sprayhead portion 17 at the outlet.

The diffuser portion 15 of the gun comprises a diffuser body 21 having a central axial passageway 22. The diffuser body 21 is fitted into the inlet end of the central opening in the gun body 11, and O-rings 23 and 24 are provided in grooves around the outer surface of the diffuser body 21, between the diffuser body and the interior surface of the inlet end of the central opening in the gun body 11.

Compressed air enters the diffuser portion 15 from a gun control module (not shown) through a connector 27. The connector 27 is connected to a diffuser nozzle 28 inserted into the forward end of the passageway 22. Powder from a hopper is conveyed to the diffuser portion 15 by flow air from a pump such as that shown in U.S. Pat. No. 4,615,649. The powder and conveying air from the pump enter the gun through a feed hose which is connected to the gun at an inlet connector 29 which extends radially into the diffuser body 21 toward the passageway 22. As the powder enters the diffuser portion 15 from the connector 29, the powder is mixed with the diffuser air from the diffuser nozzle 28. Diffuser air flowing across the powder inlet connector 29 reduces the pressure at the powder inlet which assists the pump by drawing the powder from the powder feed hose into the diffuser. The hole in the nozzle 28 in the diffuser is sized to provide a high volume air flow at low pressure.

Lower pressure in the diffuser results in less back pressure on the pump which in turn results in higher powder flow output from the pump. The high volume of diffuser air results in the powder being conveyed through the charging portion 16 at high velocity further resulting in high charging of the powder. Since the magnitude of the charge imparted to the powder is directly related to the velocity of the powder through the gun, the volume of diffuser air is essentially the way of adjusting the charging of the powder: higher diffuser air produces a higher charge on the powder, lower diffuser air a lower charge. The present invention provides a diffuser in the back of the gun to control the charge on the powder by driving the powder through the charging portion 16 at the desired velocity.

The charging portion 16 of the gun is located within an outer extension tube 31 which is removably attached to the gun body 11 and which extends from the forward end of the body. The charging portion 16 comprises an inner core assembly 32 mounted within an outer cylinder assembly 33.

As shown in FIG. 2, the inner core assembly 32 comprises a central threaded rod 35, having a generally conical inlet distributor 36 threaded on one end, and a generally frusto-conical outlet distributor 37 threaded on the other end. A generally cylindrical inner wear sleeve 38 is captured between the inlet distributor 36 and the outlet distributor 37.

The outer cylinder assembly 33 is mounted within the extension tube 31 and comprises an outer wear sleeve 40 which is captured between an inlet wear sleeve 41 and an outlet wear sleeve 42. The inlet wear sleeve 41 fits against a shoulder 39 at the outlet end of the central opening in the gun body 11. The outlet wear sleeve 42 has a shoulder 43 around its exterior, and the outlet end of the extension tube 31 has a flange 44 which extends radially inwardly to engage the shoulder 43 through a compressible gasket 45 and hold the outlet wear sleeve in place.

Thus, the inlet wear sleeve 41 is positioned around the inlet distributor 36, the outer wear sleeve 40 is positioned around the inner wear sleeve 38, and the outlet wear sleeve 42 is positioned around the outlet distributor 37.

An annular gap 46 is formed between the inner and outer wear sleeves 38 and 40. The outer surface of the inner wear sleeve 38 and the inner surface of the outer wear sleeve 40 undulate, so that the annular gap 46 provides a tortuous path for the powder passing through the charging portion 16. Specifically, the outer diameter of the inner wear sleeve 38 increases at generally the same longitudinal position that the inner diameter of the outer wear sleeve 40 increases, and the outer diameter of the inner wear sleeve 38 decreases at generally the same longitudinal position that the inner diameter of the outer wear sleeve 40 decreases, so that a narrow "wavy" flowpath for the powder is created by the annular gap 46 between the sleeves 38 and 40. The width of the annular gap 46 remains generally constant along the length of the inner and outer wear sleeves 38 and 40, although the annular gap 46 varies in diameter.

Powder enters the charging portion 16 of the gun from the diffuser portion 15 and is channelled into the annular gap 46 between the inner and outer wear sleeves 38 and 40 by the converging surfaces of the inlet wear sleeve 41 and the inlet distributor 36. The inlet wear sleeve 41, which is positioned within the gun body 11, extends from the outer wear sleeve 40 to the diffuser body 21 and defines a passage for the powder exiting the diffuser portion of the gun.

The powder then flows through the narrow, "wavy" annular gap 46 and subsequently through a widening annular gap defined by the diverging surfaces of the outlet distributor 37 and the outlet wear sleeve 42 from which the powder is discharged into the sprayhead portion 17.

To seal the powder flowpath, a plurality of O-rings are provided between various components of the gun. The inlet wear sleeve 41 is sealed against the gun body 11 by an O-ring 48 (FIG. 3) which is provided between the gun body and the inlet wear sleeve at the beginning of the charging portion 16. Another O-ring 49 is located also around the exterior of the inlet wear sleeve 41. O-rings 50 and 51 are located around the exterior of the outer wear sleeve 40, with the O-ring 50 positioned near the inlet end of the outer wear sleeve 40 (FIG. 3), and the O-ring 51 positioned between the outer wear sleeve 40 and the extension tube 31 at the outlet end of the wear sleeve (FIG. 4).

The extension tube 31 is removably attached to the gun body 11 by a bayonet-type latching mechanism comprised of a pin 52 extending from the gun body 11 into a slot 53 formed in the extension tube 31, so that the charging portion 16 is securely held to the gun body during use and may be easily removed when it is desired to clean the gun or replace one of the wear sleeves. With the extension tube 31 securely attached to the gun body 11 by the bayonet mechanism, the outer wear sleeve 40 is urged back into the central opening in the body 11 by the foam neoprene gasket 45 (FIGS. 2 and 4) located between the outer flange 44 of the extension tube 31 and the shoulder 43 of the outlet wear sleeve 42. The gasket 45 is compressible and resilient, and it forms a spring which provides a force upon the outer wear sleeve 40 toward the gun body 11. The O-ring 50 carried on the end of the outer wear sleeve 40 engages a ground ring 81 (later described) when the outer wear sleeve is pushed into the gun body 11 by the gasket 45.

Figure 5:
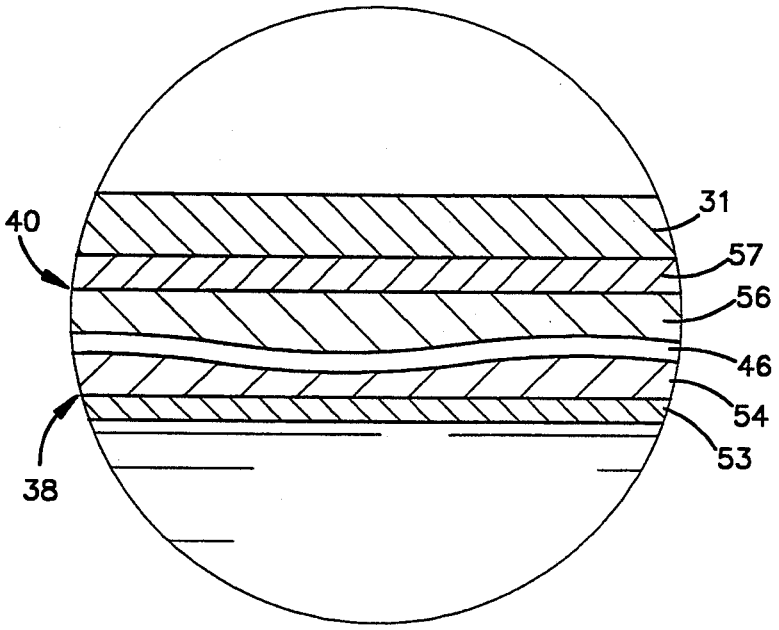
FIG. 5 is a detailed cross-sectional view another portion of FIG. 2 to a larger scale.
Figure 6:
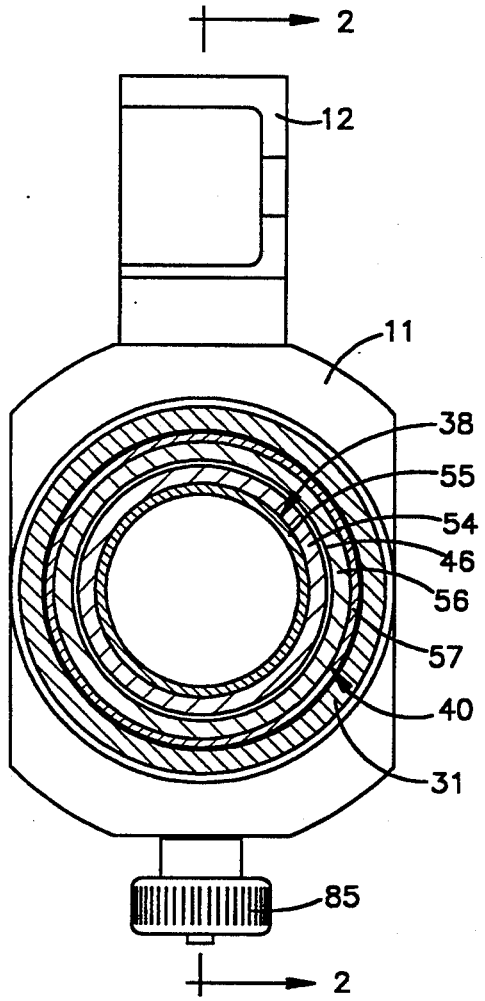
FIG. 6 is a end sectional view of the gun taken along line 6—6 of FIG. 1.

As shown in detail in FIG. 5, the inner wear sleeve 38 comprises an inner PTFE contact layer 54 formed on the outer diameter of an inner stiffening element or sleeve 55. The outer wear sleeve 40 similarly comprises an outer PTFE contact layer 56 formed on the inner diameter of an outer stiffening element or sleeve 57. The stiffening sleeves 55 and 57 are made of an electrically insulating, dimensionally stable material and preferably are made from a NEMA Grade G-10 (continuous filament woven glass-fabric impregnated with epoxy resin) or similar material. The contact layers 54 and 56 provide a layer of electrically insulating material along the powder flowpath, but also provide surface conductivity for grounding. The stiffening sleeves 55 and 57 provide reinforcement for the sleeves and help the "wavy" PTFE sleeves hold their shape, both radially and longitudinally, during machining, and over time to maintain dimensional integrity along the annular gap 46.

Referring again to FIG. 2, the position of the inner core assembly 32 with respect to the outer cylinder assembly 33 is maintained by a positioning ring 60 and a spacing ring 61. The positioning ring 60 is used both to align the inner wear sleeve 38 radially with the inlet distributor 36 at the inlet of the charging portion 16 and to align the inner wear sleeve 38 and the distributors 36 and 37 axially with the outer wear sleeve 40 and the wear sleeves 41 and 42. The spacing ring 61 is used only to align the inner wear sleeve 38 and the outlet distributor 37 radially with the wear sleeve 40 and the outlet wear sleeve 42 at the outlet of the charging portion 16. The positioning ring 60 and the spacing ring 61 are each made from an electrically insulating material which provides surface conductivity, such as Delrin.

Figure 3:
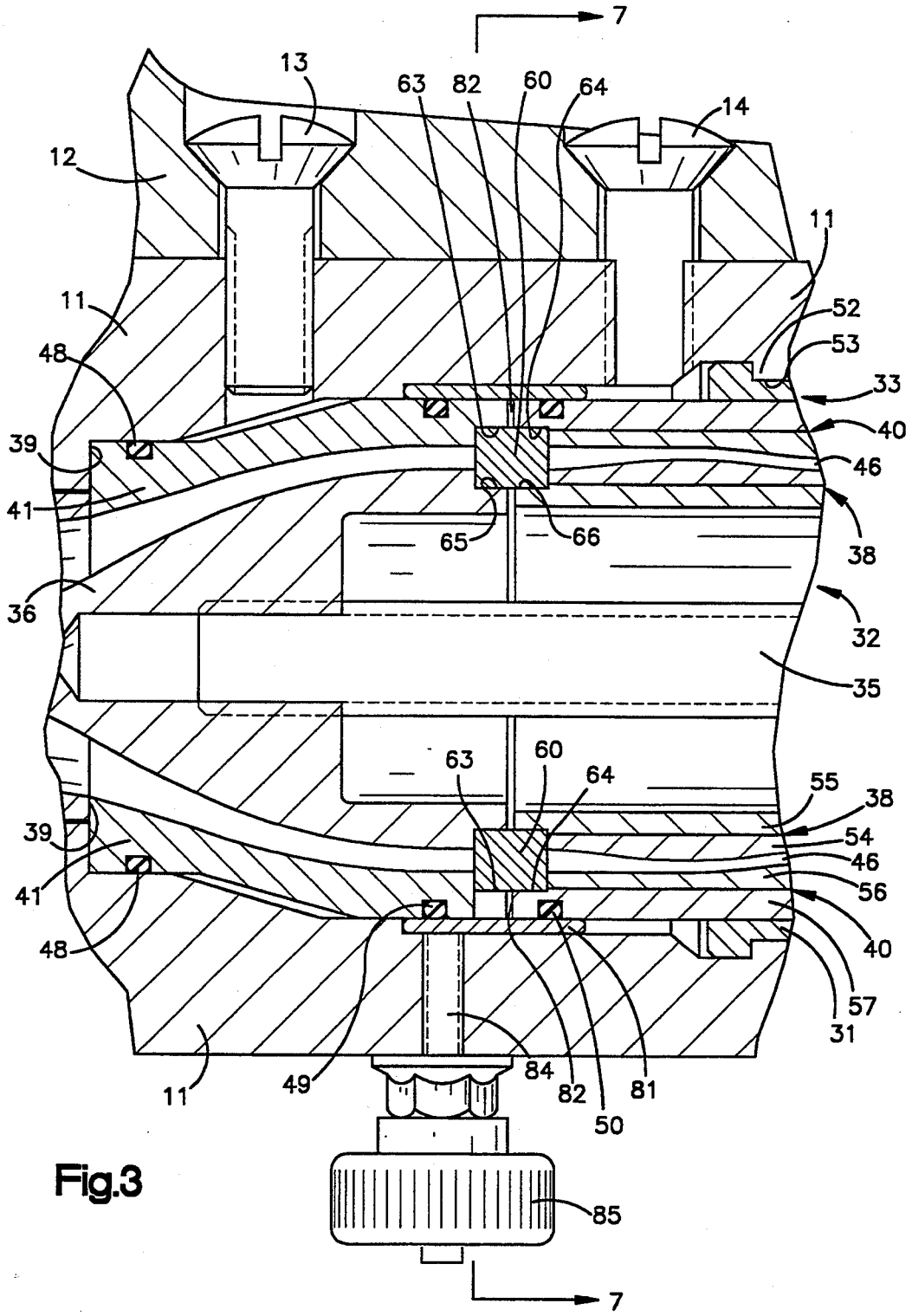
FIG. 3 is a detailed cross-sectional view a portion of FIG. 2 to a larger scale.
Figure 4:
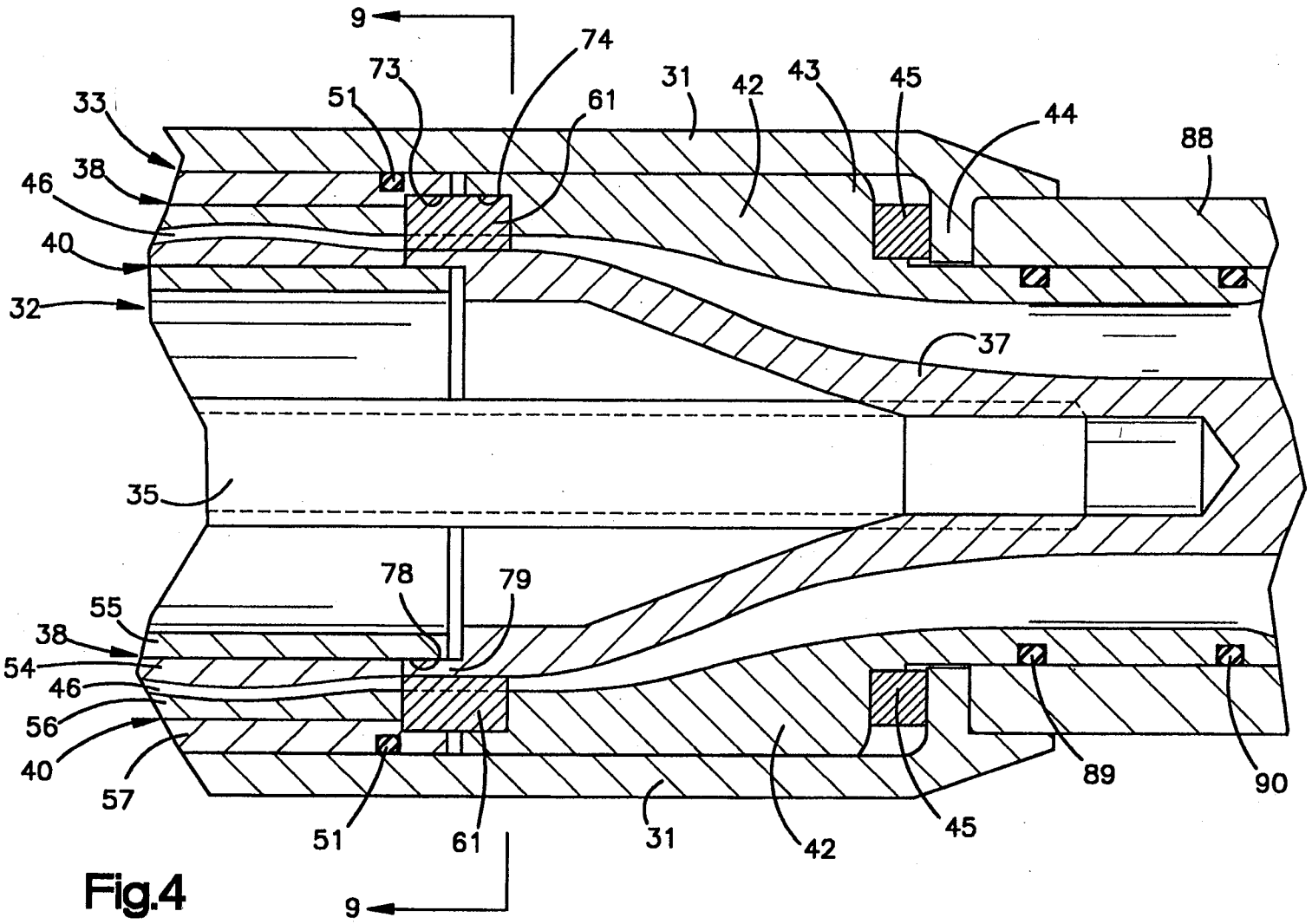
FIG. 4 is a detailed cross-sectional view of another portion of FIG. 2 to a larger scale.

As shown in FIG. 3, the positioning ring 60 is located between the inlet wear sleeve 41 and the outer wear sleeve 40 and between the inlet distributor 36 and the inner wear sleeve 38. A small recess 63 is formed around the inner surface of the inlet wear sleeve 41 adjacent to the outer wear sleeve 40 to provide for the positioning ring 60. Similarly, a recess 64 is formed around the inner surface of the outer wear sleeve 40 adjacent to the inlet wear sleeve 41 to provide for the positioning ring 60. Corresponding recesses 65 and 66 are formed in the outer surfaces of the inlet distributor 36 and the inner wear sleeve 38, respectively, to provide for the positioning ring 60. In this way the positioning ring 60, best shown in FIG. 7, is captured in the recesses 63, 64, 65 and 66.

Figure 7:
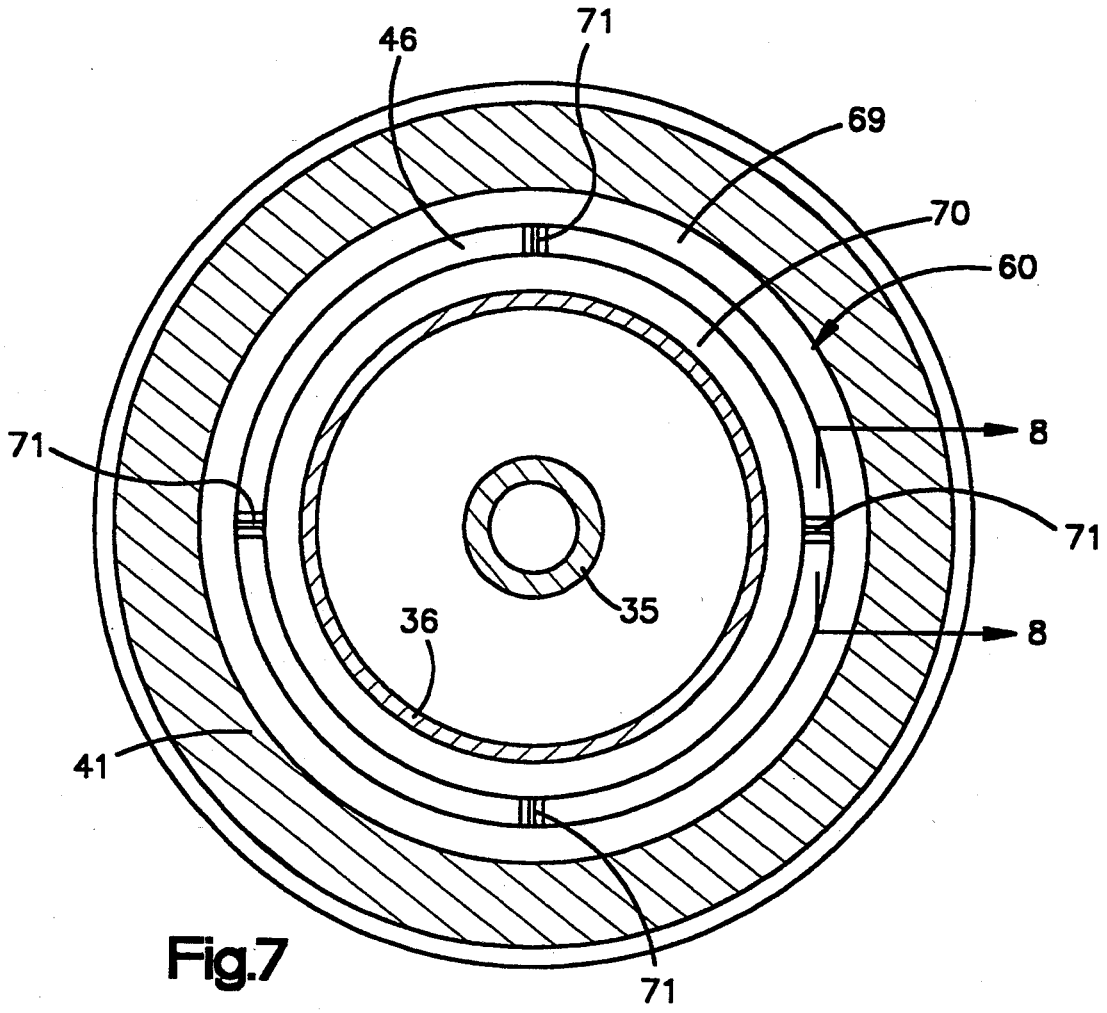
FIG. 7 is a sectional view taken along line 7—7 of FIG. 3.
Figure 8:
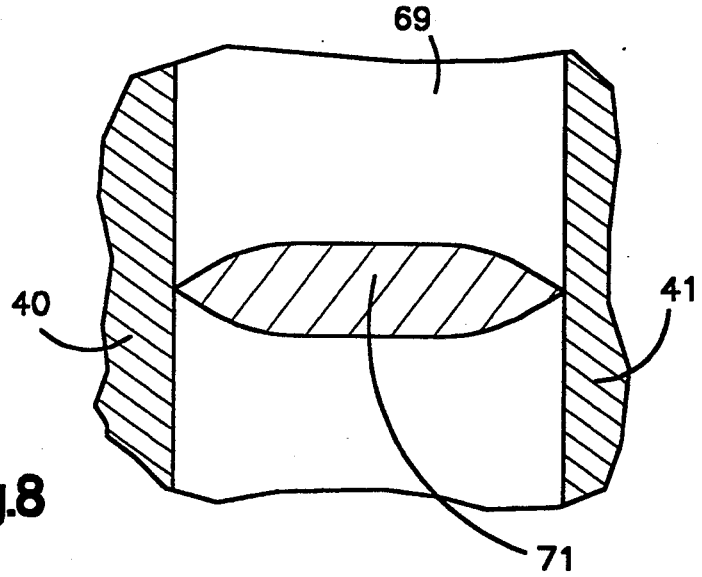
FIG. 8 is a sectional detail view taken along line 8—8 of FIG. 7.

The structure of the positioning ring 60 is shown in more detail in FIG. 7. The positioning ring 60 comprises an outer ring portion 69 which is captured in the recesses 63 and 64 between the inlet wear sleeve 41 and the outer wear sleeve 40, and an inner ring portion 70 which is captured in the recesses 65 and 66 between the inlet distributor 36 and the inner wear sleeve 38. The inner ring portion 70 and the outer ring portion 69 are connected by four web portions 71 which are located 90° apart with respect to each other. The web portions 71 extend through the path of the powder, and, as shown particularly in FIG. 8, the web portions have a tapered or streamlined cross section to reduce the build-up of powder on the web portions which would otherwise be caused by impact fusion of the powder.

The recess 64 in the outer wear sleeve 40 extends completely through the outer PTFE contact layer 56 and into the outer stiffening sleeve 57. Likewise, the recess 66 in the inner wear sleeve 38 extends completely through the inner PTFE contact layer 54 and into the inner stiffening sleeve 55. The material of the stiffening sleeves 55 and 57 is more rigid than the softer PTFE material of the contact layers 54 and 56, and the depth of the recesses into the stiffening sleeves provides dimensional stability to the positioning of the ring 60. The recesses 63, 64, 65 and 66 thus provide for precise axial placement of the positioning ring 60 with respect to the outer cylinder assembly 33 and the inner core assembly 32.

Figure 9:
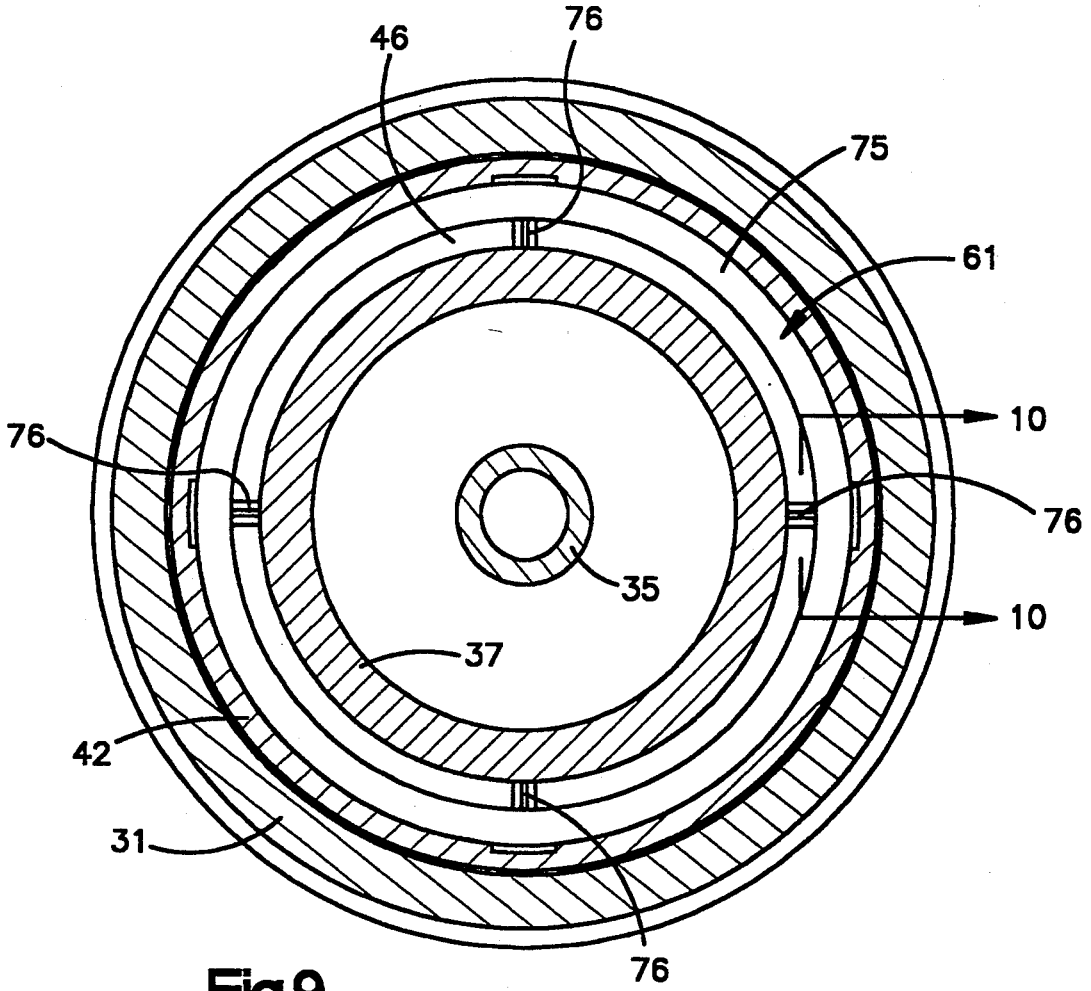
FIG. 9 is a sectional view taken along line 9—9 of FIG. 4.
Figure 10:
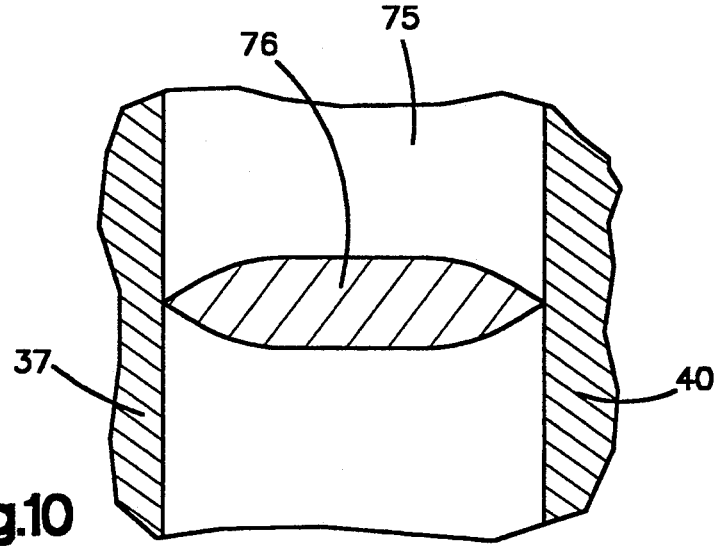
FIG. 10 is a sectional detail view taken along line 10—10 of FIG. 9.

The spacing ring 61 is located between the outer wear sleeve 40 and the outlet wear sleeve 42. As shown in FIG. 4, a recess 73 is formed in the outer wear sleeve 40 at the outlet edge, and a corresponding recess 74 is formed in the outlet wear sleeve 42. The spacing ring 61 fits within the groove formed by the recesses 73 and 74. As shown in FIG. 9, the spacing ring 61 comprises an outer ring portion 75 that fits within the groove formed by the recesses 73 and 74 and four projecting spacer portions 76 that extend radially inwardly from the outer ring portion 75. The spacer portions 76 are located 90° apart with respect to each other. The tips of the spacer portions 76 engage the outer wall of the outlet distributor 37 to radially position the outer cylinder assembly 33 with respect to the inner core assembly 32. As shown in FIG. 10, the spacer portions 76 also have a tapered or streamlined cross section, similar to the web portions 71 for the positioning ring 60, to prevent the build-up of power due to impact fusion.

A recess 78 (FIG. 4) is also provided on the other end of the inner wear sleeve 38 opposite the recess 66. This recess 78 is not needed for the positioning of the spacing ring 61 since the spacing ring is not mounted in the inner core assembly. However, the recess 78 is provided so that the inner wear sleeve 38 is longitudinally symmetrical, i.e., reversible. The recess 78 is thus symmetrically located with respect to the recess 66 on the other end of the inner wear sleeve 38. Since the recess 78, as shown in FIG. 4, is not needed for the spacing ring 61, the outlet distributor 37 is provided with a small flange 79 which fits within the recess 78.

In accordance with conventional design of tribo-electric powder spray guns, the charging portion 16 is grounded to enhance the charging of the powder and promote safety by preventing the gun from storing a capacitive charge which could shock an operator or produce a spark, causing a fire or explosion. The present invention, however, utilizes an improved grounding configuration. A ground electrode is provided in the form of a ground ring 81 located within the gun body 11 and around the exterior of the inlet wear sleeve 41 and the outer wear sleeve 40, near the inlet of the charging portion 16 where the highest charge transfer to the powder occurs. The ground ring 81 is located away from the powder flowpath, so that it is kept clean, resulting in a good, consistent electrical ground. The O-ring 49 is located between the ground ring 81 and the inlet wear sleeve 41, and the O-ring 50 is located between the ground ring 81 and the outer wear sleeve 40.

The outer wear sleeve 40 is a separate element from the inlet wear sleeve 41 to allow for a gap 82 to be formed therebetween. The gap 82 may not be significant in dimension, and the elements 40 and 41 forming the gap may, in fact, be touching or abutting each other. Even if the elements 40 and 41 are abutted together in contact, the effect of a gap will still occur between these elements which will be sufficient for the passage of charge to the ground ring 81 by surface conduction along the abutted surfaces of the elements 40 and 41. The gap 82 is annular and is shown to indicate that exterior surfaces are provided between the outer wear sleeve 40 and the inlet wear sleeve 41, so that surface conduction can occur along these surfaces as part of the grounding path.

The electrical grounding of the elements of the charging portion 16 of the gun is accomplished by surface conduction along the exterior surfaces of the inner wear sleeve 38, the outer wear sleeve 40, the inlet wear sleeve 41, the inlet distributor 36, the outlet distributor 37 and the outlet wear sleeve 42. As previously described, at least the surfaces of these parts which form a part of the powder flowpath are formed of an electrically insulating material with good charging properties, such as PTFE. The PTFE material also allows for surface discharge which provides a conductive path for grounding. The charge on the surfaces of the inlet wear sleeve 41, the outer wear sleeve 40 and the outlet wear sleeve 42 flows along those surfaces to the ground ring 81 through the gap 82 provided between the inlet wear sleeve 41 and the outer wear sleeve 40. The charge on the surfaces of the inlet distributor 36, the inner wear sleeve 38 and the outlet distributor 37 flows along those surfaces and across the surface of the positioning ring 60 to the ground ring 81 through the gap 82. Some charge from these surfaces most likely also flows across the spacing ring 61 to the outer wear sleeve 40 before passing along the gap 82. Because the rings 60 and 61 are also made of an electrically insulating material providing adequate surface conductivity, such as Delrin, they provide sufficient discharge current transfer from the inner core elements 36, 37 and 38 to the ground ring 81.

From the ground ring 81, the current flows through a ground stud 84 to a ground wire (not shown) held onto the ground stud 84 by a knob 85, which leads back to the gun control module where it is displayed by means of an ammeter and then flows to ground. The surface conductivity of the PTFE, the length of the path to the ground ring 81 and the electrical potential of the charge on the powder contact surfaces are all variables considered in the design of the gun for proper grounding and optimum charging performance.

The outlet end of the charging portion 16 of the gun is designed to accept various conventional sprayheads. As shown, the sprayhead portion 17 comprises a conventional sprayhead 88 which is shown to illustrate the mounting of a sprayhead to the outlet end of the charging portion 16. The sprayhead 88 is mounted on the outlet wear sleeve 42 adjacent to the flange 44 on the outlet end of the extension tube 31. The O-rings 89 and 90 (FIG. 4) are located in grooves on the exterior of the outlet wear sleeve 42 between the sprayhead 88 and the outlet wear sleeve.

The magnitude of the charge imparted to the powder in the charging portion 16 is a function of (1) the velocity of the powder, (2) the material from which the flowpath walls are made, (3) the geometry or design of the powder flowpath through the charging portion, (4) the electrical grounding of the charging surfaces, and (5) the composition of the powder coating material. The gun of the present invention is designed to maximize the charge imparted to the powder through consideration of each of the above five factors.

One of the important factors in the magnitude of the charge imparted to the powder is the velocity of the powder through the charging portion 16 of the gun; the higher the velocity of the powder, the higher the charge on the powder. However, the velocity of the powder also has a detrimental effect on the wear life of the powder gun parts. Wear of the parts is also a function of velocity; the higher the velocity, the higher the wear. Therefore, it is not desirable to flow the powder at any greater velocity than is required for adequate charging.

In the preferred embodiment of the present invention, all of the parts which the powder can contact in the charging portion 16 of the gun, namely the inner wear sleeve 38, the outer wear sleeve 40, the inlet wear sleeve 41, the inlet distributor 36, the outlet distributor 37, and the outlet wear sleeve 42, are made of a fluoropolymer material, preferably polytetrafluoroethylene (PTFE). This material has been found to be very effective for tribo-electrically charging powdered paints of various compositions. The powder picks up charge with each contact with a PTFE surface. Therefore, maximizing the PTFE surface area exposed to the powder maximizes the opportunity to charge the powder. PTFE is an electrically insulating material but has surface conductivity to provide from grounding of the charges imparted to the powder.

The unique design of the inner and outer wear sleeves 38 and 40, specifically their "wavy" surfaces, also serves to increase the magnitude of the charge imparted to the powder. The curved surfaces of the inner and outer wear sleeves 38 and 40 cause the powder to flow in a tortuous path through the annular gap 46, thus forcing the powder against the peaks and valleys or grooves of the each of the sleeve. Each change in diameter of the sleeves 38 and 40 forces the powder to change direction and further impact the PTFE surfaces of the sleeves adding to the charge on the powder.

The magnitude of the charge imparted to the powder is further enhanced by the relatively narrow width of the annular gap 46. The annular gap between the two wear sleeves 38 and 40 is small, on the order of 0.032 inches (0.82 mm). The powder, therefore, has a high probability of contacting the surfaces of the wear sleeves 38 and 40 many times rather than flowing straight through the charging portion with relatively few contacts. As previously described, this narrow width of the annular gap 46 between the inlet wear sleeve 41, outlet wear sleeve 42, inner wear sleeve 38 and the inlet distributor 36, outlet distributor 37, and the outer wear sleeve 40 is maintained by the positioning ring 60 and the spacing ring 61.

Since the charge imparted to the powder is increased by increasing the velocity of the powder through the charging portion 16 of the gun, and since increasing the velocity of the powder increases the wear of the powder gun parts, it is advantageous to provide for easy replacement of worn parts. The present invention facilitates replacement of the two wear sleeves 38 and 40. The two wear sleeves 38 and 40 are dimensioned so that the inner wear sleeve 38 can be removed from the outer wear sleeve 40 by pushing or pulling the inner wear sleeve out either end of the outer wear sleeve. This removability is accomplished by dimensioning the diameter of the peaks or ridges of the inner wear sleeve 38 to be less than or at most equal to the diameter of the peaks or ridges of the outer wear sleeve 40. When either of the sleeves 38 and 40 worn out, a new sleeve can easily be substituted in the field without the necessity of sending the entire gun back to the manufacturer to be rebuilt, resulting in savings in time and expense.

To assemble the gun 10, the positioning ring 60 is first placed into the recess 66 on one end of the inner wear sleeve 38. It is noted that the inner wear sleeve 38 is longitudinally symmetrical, so that assembly can begin by placing the positioning ring 60 on either end of the inner wear sleeve. The inlet distributor 36 is then positioned on the same end of the inner wear sleeve with the positioning ring in the recess 65. The threaded rod 35 is then inserted into the corresponding threaded opening in the inlet distributor 36. The outlet distributor 37 is then threaded onto the other end of the rod 35, and the assembly of the inner core assembly 32 is complete.

The body 11 is preassembled with the diffuser body 21, the gun mount assembly 12, the ground ring 81, the ground stud 84 and the knob 85 in place. The O-rings 48 and 49 are positioned around the exterior of the inlet wear sleeve 41 in groove provided for the O-rings, and the inlet wear sleeve is inserted into outlet end of the central opening in the gun body 11. The previously assembled inner core assembly 32 is then inserted with the inlet distributor 36 fitting into the inlet wear sleeve 41 and the positioning ring 60 fitting into the recess 63 in the inlet wear sleeve. Next, the O-ring 50 is positioned in the groove provided on the exterior of the outer wear sleeve 40. Then, the outer wear sleeve 40 is inserted into the central opening of the body 11 until the positioning ring 60 is seated in the recess 64 on the end of the outer wear sleeve. It is noted that the outer wear sleeve 40 is longitudinally symmetrical, so that either end of the outer wear sleeve may be inserted into the gun body 11 during assembly.

The spacing ring 61 is then placed around the outlet distributor 37 and positioned upon the outwardly extending end of the outer wear sleeve 40 in the recess 73. The O-rings 89 and 90 are pre-assembled on the outlet wear sleeve 42 in the grooves provided on the exterior of the outlet wear sleeve, and the outlet wear sleeve 42 is then positioned on the outwardly extending end of the outer wear sleeve 40 with the spacing ring 61 received within the recess 74 of the outlet wear sleeve 42. The neoprene gasket 45 is placed against the shoulder 43 of the outlet wear sleeve 42, and the extension tube 31 is placed over the outwardly extending assembly. As the extension tube 31 is rotated, the pin 52 locates the opening into the slot 53, and the extension tube is pushed into the central opening of the body 11 around the outer wear sleeve 40, with the flange 44 engaging the neoprene gasket 45 and compressing it. This urges the outlet wear sleeve 42, the outer wear sleeve 40, the positioning ring 60 and the inlet wear sleeve 41 toward the body 11, so that the inlet wear sleeve 41 is pressed against the shoulder 39 of the gun body 11. This also axially positions the inner core assembly 32 which is positioned within the outer wear sleeve 40 by the positioning ring 60 and the spacing ring 61. The extension tube 31 is locked to the body 11 by rotating it ⅛ turn to engage the pin 52 into the detent at the end of the slot 53. The desired sprayhead 88 can then be mounted on the end of the outlet wear sleeve 42.

The gun can also be easily disassembled for cleaning or for replacement of the wear sleeves 38 and 40. The wear sleeves 38 and 40 are removed from the gun by first removing the sprayhead 88 from outlet wear sleeve 42. The extension tube 31 is next disengaged from the gun body 11 by rotating the extension tube and disengaging the bayonet mechanism. Thereafter, the outlet wear sleeve 42 and the outlet distributor 37 may be removed, and the inner wear sleeve 38 may be removed from the outer wear sleeve 40, or the outlet wear sleeve 42 and the outer wear sleeve 40 may be removed from the inner wear sleeve 38.

The re-assembly of the wear sleeves and the replacement of a worn sleeve with a new wear sleeve is further facilitated by the design of the wear sleeves 38 and 40. The wear sleeves 38 and 40 are each symmetrical so that they can be assembled into the gun with either end first. This prevents incorrect insertion of one of the wear sleeve 38 or 40 into the other wear sleeve in the field and prevents inadvertent misalignment of the wear sleeves and resulting incorrect dimensioning of the annular gap 46.

Another important factor in the magnitude of the charge imparted to the powder is proper electrical grounding of the gun. The ground ring 81 is located away from the powder flowpath near the inlet of the charging portion 16. The ground ring 81 is located in the region of the gun where the greatest amount of charging occurs, and this location is, therefore, the preferred location to bleed off charge. By locating the ground ring 81 outside the powder path, the ground ring is kept clean from the build-up of powder, resulting in a good, consistent electrical ground.

Various modifications and improvements can be made to the invention shown and described. For example, the dimension and geometry of the waves formed by the exterior surfaces of the sleeves 38 and 40 can be modified. Similarly, more or fewer waves can be provided.

The exterior surfaces of the sleeves 38 and 40 can be made of other materials that may be longer wearing and that may tribo-electrically charge powder as well as PTFE does, such as perfluoroalkoxy (PFA) and Tefzel®, modified ethyltetrafluoroethylene fluoropolymer.

The inner and outer wear sleeves 38 and 40 can also be injection molded to facilitate manufacture and reduce fabrication costs. In order to make the sleeves using an injection molding process, an injection moldable material, such as PFA, FEP or Tefzel, would be used instead of PTFE, which is only extrudable and compression moldable. If the stiffening sleeves 55 and 57 are made out of a NEMA Grade G-10 (continuous filament woven glass-fabric impregnated with epoxy resin) or similar material, the PFA may be injection molded onto the G-10 tube and then, if needed, the wave may be finished by machining on the PFA portion of the assembly.

In addition, instead of gluing the inner contact layer 54 to the inner stiffening sleeve 55 and the outer contact layer 56 to the outer stiffening sleeve 57, these materials can be frictionally secured together. To accomplish this, the inner PTFE contact layer 54 could be heated to expand it, and the inner contact layer could be slid over the inner stiffening sleeve 55 and cooled to shrink it onto the sleeve 55. In like manner, the outer contact layer 56 can be super-cooled, such as in liquid nitrogen, to shrink it, and inserted into the outer stiffening sleeve 57. The outer contact layer 56 can then be heated back to room temperature to expand it into a compression fit with the sleeve 57.

The annular gap 46 through which the powder flows may also vary in width as a function of its radius from the gun centerline, so that the width of the annular gap is smaller at a larger radius. This would be done in order to approximate a constant cross-sectional area for the powder path in order to maintain the powder at a relatively constant velocity as it passes through the charging portion 16.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiment herein shown and described nor in any other way this is inconsistent with the extent to which the progress in the art has been advance by the invention.

What is claimed is:

1. A tribo-electric powder spray gun, which comprises:

a mixing section in which powder is mixed with a conveying gas;

a charging section downstream of the mixing section in which the powder is electrically charged as it flows therethrough, the charging section comprising an inner core having at least one inner core member positioned within a hollow outer cylinder having at least one outer cylinder member, the outer cylinder member having an inner dimension, the inner core member having an outer dimension, an annular gap being formed between the outer cylinder member and inner core member providing a friction charging flowpath for the powder, the outer dimension of the inner core member and the inner dimension of the outer cylinder member each have a plurality of increases and decreases providing undulating charging surfaces, the outer dimension of the inner core member increasing at generally the same longitudinal position that the inner dimension of the outer cylinder member increases, the outer dimension of the inner core member decreasing at generally the same longitudinal position that the inner dimension of the outer cylinder member decreases, the charging surfaces of the inner core member and the outer cylinder member each made of electrically insulating material, whereby the powder is frictionally charged by repeated contact with the cylinder member and the core member during flow through the annular gap; and a sprayhead downstream of the charging section for dispensing the charged powder.

2. The tribo-electric powder spray gun of claim 1, further comprising a ground electrode located externally to the flowpath of the powder.

3. The tribo-electric powder spray gun of claim 2, wherein the ground electrode comprises a ground ring around the exterior of the outer cylinder.

4. The tribo-electric powder spray gun of claim 3, wherein a second gap is present between elements forming part of the powder flowpath to provide for surface conduction between elements, the second gap being positioned adjacent to the ground ring.

5. The tribo-electric powder spray gun of claim 4, comprising in addition at least one ring made from electrically insulating material provided between the inner core and the outer cylinder in contact with the charging surfaces thereof.

6. The tribo-electric powder spray gun of claim 1, wherein the inner core includes an inner wear sleeve formed of a stiffening element with an external contact layer made of an electrically insulating material forming a charging surface.

7. The tribo-electric powder spray gun of claim 1, wherein the outer cylinder includes an outer wear sleeve formed of a stiffening element with a contact layer made of an electrically insulating material forming a charging surface.

8. The tribo-electric powder spray gun of claim 1, wherein the inner core is removable from the outer cylinder, and the largest outer dimension of the inner core is smaller than the smallest inner dimension of the outer cylinder to permit the inner core to be removed longitudinally from the outer cylinder.

9. The tribo-electric powder spray gun of claim 1, wherein the width of the annular gap remains generally constant along the length of the outer cylinder member and the inner core member.

10. The tribo-electric powder spray gun of claim 1, wherein the mixing section includes a diffuser at the inlet end of the gun, the diffuser including a first inlet for the powder suspended in a gas and a second inlet for the conveying gas.

11. The tribo-electric powder spray gun of claim 10, wherein the diffuser controls the charge on the powder by driving the powder through the charging section at a selected velocity.

12. The tribo-electric powder spray gun of claim 1, wherein the inner core includes an inlet distributor and the outer cylinder includes an inlet wear sleeve, the inlet distributor and the inlet wear sleeve defining a diverging annular inlet to the annular gap between the inner core member and the outer cylinder member.

13. The tribo-electric powder spray gun of claim 12, wherein the inlet distributor and the inlet wear sleeve are constructed of electrically insulating material.

14. The tribo-electric powder spray gun of claim 1, wherein the inner core includes an outlet distributor and the outer cylinder includes an outlet wear sleeve, the outlet distributor and the outlet wear sleeve defining a converging annular outlet from the annular gap between the inner core member and the outer cylinder member.

15. The tribo-electric powder spray gun of claim 14, wherein the outlet distributor and the outlet wear sleeve are constructed of electrically insulating material.

16. The tribo-electric powder spray gun of claim 1, wherein the inner core member includes an inner wear sleeve and the outer cylinder member includes an outer wear sleeve, the inner wear*sleeve and the outer wear sleeve each being removable from the spray gun separately from other elements of the gun.

17. The tribo-electric powder spray gun of claim 16, wherein the inner wear sleeve is longitudinally symmetrical, whereby it can be re-inserted into the outer wear sleeve in either direction.

18. The tribo-electric powder spray gun of claim 16, wherein the outer wear sleeve is longitudinally symmetrical, whereby the inner wear sleeve can be re-inserted into it in either direction.

19. A tribo-electric powder spray gun, which comprises:

a mixing section in which powder is mixed with a conveying gas;

a charging section downstream of the mixing section in which the powder is electrically charged as it flows therethrough, the charging section comprising an inner core positioned within a hollow outer cylinder, an annular gap being formed between the outer cylinder and inner core providing a friction charging flowpath for the powder, at least one of the inner core and outer cylinder being electrically connected to ground through an annular ground ring positioned externally to the flowpath of the powder, the ground ring located at the inlet of the charging section and extending along substantially less than half of the charging section, whereby the powder is frictionally charged by repeated contact with the cylinder and the core during flow through the annular gap; and a sprayhead downstream of the charging section for dispensing the charged powder.

20. The tribo-electric powder spray gun of claim 19, wherein the ground ring is located around the exterior of the outer cylinder.

21. The tribo-electric powder spray gun of claim 19, wherein a second gap is present between elements forming part of the powder flowpath, the second gap being positioned adjacent to the ground electrode.

22. The tribo-electric powder spray gun of claim 19, wherein the mixing section includes a diffuser at the inlet end of the gun, the diffuser including a first inlet for the powder suspended in a gas and a second inlet for conveying gas.

23. A tribo-electric powder spray gun which comprises:

a mixing section in which powder is mixed with a conveying gas;

a charging section downstream of the mixing section in which the powder is electrically charged as it flows therethrough, the charging section comprising an inner core-positioned within a hollow outer cylinder, the inner core and the outer cylinder each having inner charging surfaces, an annular gap being formed between the outer cylinder and inner core providing a friction charging flowpath for the powder, at least one of the inner core and outer cylinder being electrically connected to ground through a ground electrode located externally to the flowpath of the powder, the ground electrode being positioned at the inlet to the charging section, a second gap being present between elements forming part of the powder flowpath, the second gap being positioned adjacent to the ground electrode, there being at least one ring made of electrically insulating material located between the inner core and the outer cylinder, the ring being in contact with the charging surfaces, whereby the powder is frictionally charged by repeated contact with the cylinder and the core during flow through the annular gap; and a sprayhead at the outlet of the charging section for dispensing the charged powder.

24. A tribo-electric powder spray gun which comprises:

a mixing section in which powder is mixed with a conveying gas;

a charging section downstream of the mixing section in which the powder is electrically charged as it flows therethrough, the charging section comprising an inner core having at least one inner core member positioned within a hollow outer cylinder having at least one outer cylinder member, the outer cylinder member having an external inner dimension and the inner core member having an external outer dimension, the outer dimension of the inner core member and the inner dimension of the outer cylinder member each having a plurality of increases and decreases providing undulating inner charging surfaces, the outer dimension of the inner core member increasing at generally the same longitudinal position that the inner dimension of the outer cylinder member increases, the outer dimension of the inner core member decreasing at generally the same longitudinal position that the inner dimension of the outer cylinder member decreases, an annular gap being formed between the outer cylinder member and inner core member providing a friction charging flowpath for the powder, at least one of the inner core member and outer cylinder member being electrically connected to ground through a ground electrode located externally to the flowpath of the powder, whereby the powder is frictionally charged by repeated contact with the cylinder member and the core member during flow through the annular gap; and a sprayhead downstream of the charging section for dispensing the charged powder.

25. A tribo-electric powder spray gun which comprises:

a mixing section in which powder is mixed with a conveying gas;

a charging section downstream of the mixing section in which the powder is electrically charged as it flows therethrough, the charging section comprising an inner core positioned within a hollow outer cylinder, the outer cylinder including an outer wear cylinder formed of a stiffening element with a contact layer forming an outer charging surface, the inner core including an inner wear cylinder formed of a stiffening element with a contact layer forming an inner charging surface, the stiffening elements being made from a NEMA Grade G-10 material, an annular gap being formed between the outer charging surface and the inner charging surface providing a friction charging flowpath for the powder, whereby the powder is frictionally charged by repeated contact with the charging surfaces during flow through the annular gap; and a sprayhead at the outlet of the charging section for dispensing the charged powder.

26. The tribo-electric powder spray gun of claim 25, wherein the inner core comprises a diverging inlet distributor and a converging outlet distributor installed on opposite ends of the inner wear cylinder.

27. A tribo-electric powder spray gun, which comprises:

a body;

a mixing section mounted on the body in which powder is mixed with a conveying gas;

a charging section removably attached to the body downstream of the mixing section in which the powder is electrically charged as it flows therethrough, the charging section comprising an inner core positioned within a hollow outer cylinder, the inner core being positioned relative to the outer cylinder by at least one ring located between the inner core and the outer cylinder, an annular gap being formed between the outer cylinder and inner core providing a friction charging flowpath for the powder, whereby the powder is frictionally charged by repeated contact with the cylinder and the core during flow through the annular gap, a tubular extension fitting over the outer cylinder and removably attached to the body to releasably secure the inner core and the outer cylinder to the body; and a sprayhead at the outlet of the charging section for dispensing the charged powder.

28. The tribo-electric powder spray gun of claim 27, wherein the inner core and the outer cylinder are releasably secured to the body by a bayonet connection between the tubular extension and the body.

* * * * *

UNITED STATES PATENT AND TRADEMARK OFFICE

CERTIFICATE OF CORRECTION

PATENT NO. : 5,402,940
DATED : April 4, 1995
INVENTOR(S) : Haller, Knobbe, Crum

It is certified that error appears in the above-indentified patent and that said Letters Patent is hereby corrected as shown below:

Col.14, line 2, "wear*sleeve" should be --wear sleeve --.

Col. 14, line 54, "core-positioned" should be --core positioned --.

Signed and Sealed this

Sixth Day of June, 1995

*Attest:*

*Attesting Officer*

BRUCE LEHMAN

*Commissioner of Patents and Trademarks*